United States Patent [19]

Hazlett

[11] 4,405,008

[45] Sep. 20, 1983

[54] ADJUSTABLE HEAT SHIELD

[75] Inventor: Robert L. Hazlett, Tucson, Ariz.

[73] Assignee: Effie Hoopman Hazlett, Tucson, Ariz.

[21] Appl. No.: 907,644

[22] Filed: May 22, 1978

[51] Int. Cl.[3] ..... E05D 15/00

[52] U.S. Cl. ..... 160/213; 160/32; 160/229 R; 160/232

[58] Field of Search ..... 160/68, 207, 213, 231 R, 160/231 A, 232, 229, 230, 84 R, 32; 49/397

[56] References Cited

U.S. PATENT DOCUMENTS

| | | | |
|---|---|---|---|
| 1,107,985 | 8/1914 | Moskowitz | 160/231 R |
| 2,092,523 | 9/1937 | Post | 160/213 |
| 2,521,263 | 9/1950 | Sorenson | 160/213 |
| 2,829,081 | 4/1958 | Sweem | 160/230 |
| 3,074,474 | 1/1963 | Dunn | 160/68 |
| 3,289,740 | 12/1966 | Heier, Jr. | 160/213 |
| 3,511,301 | 5/1970 | Graham et al. | 160/232 |
| 3,635,278 | 1/1972 | Bocade | 160/231 A |
| 3,871,278 | 3/1975 | Shoemaker | 160/213 |
| 3,967,671 | 7/1976 | Stanley et al. | 160/232 |
| 4,083,395 | 4/1978 | Romano | 160/84 R |
| 4,084,347 | 4/1978 | Brown | 49/397 |

FOREIGN PATENT DOCUMENTS

| | | | |
|---|---|---|---|
| 2729871 | 1/1979 | Fed. Rep. of Germany | 160/213 |

*Primary Examiner*—Peter M. Caun

*Attorney, Agent, or Firm*—Richard R. Mybeck

[57] ABSTRACT

An adjustable thermal shield adapted for installation upon residences, office buildings, mobile homes, recreational vehicles and other structures or objects having areas such as glass walls, windows and the like, for which enhanced thermal efficiencies are either desired or required. Each shield comprises a panel formed of rigid plastic foam which is encased in a specially prepared fabric to provide a skin-tight cover having an extending flap to provide pivot means between the panel and a like panel or the installation assembly, as the case may be.

6 Claims, 9 Drawing Figures

ADJUSTABLE HEAT SHIELD

The present invention relates to novel means for conserving energy and more particularly to novel thermal shields adapted for installation on residences, office buildings, mobile homes, recreational vehicles and other structures or objects in which enhanced thermal efficiencies are either required or desired.

Thus, as will hereafter appear in detail, the present invention provides convenient means for readily controlling or limiting the transfer of heat between adjacent areas having significant differences in temperature thereby obstructing the loss of cooling or heating from the one, e.g., an inside room, to the other, e.g., the out-of-doors. In this way, the energy efficiency of the area which is relying upon commercial power generation to obtain a desired temperature condition is greatly enhanced.

In the era of the so-called window wall and the arcadia door, that is, that channel-mounted laterally slideable door formed of large panes of glass framed in metal mountings which track in the channels, the loss of cool air (by the entrance of heat) in the summer months and the loss of heated air in the winter months (assuming the Northern hemisphere) through these large expanses of glass greatly add to the energy cost of cooling and heating such structures. More importantly, these panes are a source of great energy waste at a time when energy conservation is of utmost importance to our national economy and well-being.

Now, more than ever before, man has become extremely energy conscious because of the cost of the energy that is available and also because energy is not always available at the time and in the amount required to meet man's needs.

Notwithstanding the advent of the so-called "thermal pane" glass and the sun reflective plastic films which are adhered to regular glass panes, windows and glass doors still are one of the most obvious sources of energy loss. Still, the air conditioned home (that is, one cooled by conventional refrigeration, by a heat pump, or by evaporative cooler) loses energy values by the adverse effect obtained as neutralizing heat passes into the cooled rooms and the heated homes loses energy values as the heat is not retained therein but instead passes to the cooler outside through the panes.

Nor is the elimination of all such doors and windows a practical solution because there are times when the heat transfer obtainable therethrough is desirable and beneficial such for instance as when solar heat passes through such openings during winter months to augment internal heating or when the opening of such windows to catch the cool breeze during summer nights augments internal cooling.

Other systems heretofore employed to prevent the entry of solar heat into the home during summer days which met with varying degrees of success have included exterior awnings, roll blinds and draperies which normally are slideably mounted to the wall above the window inside of a house but which are not practical for mounting adjacent a sliding door. The blinds and drapes, when in their closed position, are only nominally effective in preventing the transference of heat into a room, but do not prevent the transference of the heat through the glass. More recently, light reflective plastic films have been introduced which are applied on the glass and have encountered some success although at night they also obstruct vision through the window to which they are applied and they further convert such window surfaces into mirror-like objects in daylight hours which pose hazards for passing motorists and are clearly an annoyance to nearby neighbors.

The present invention is predicated upon my design of a unique thermal shield, for operative installation adjacent windows, doors and the like and to control selectively the passage of energy therethrough to minimize energy waste while preserving man's ability to utilize selectively the transfer of energy therethrough when operating exegencies render it desirable.

Thus, I have developed a novel heat shield, useful alone or in sets, which may be readily installed above the sill or to the eaves of a structure and are readily controlled to effect to a preselected degree, the transfer of energy through the associated window or door and thereby attack the problem of energy waste by providing a remarkable solution therefor.

Accordingly, a principal object of the present invention is to provide a new and improved heat shield for ready installation upon windows and like openings whereby the transfer of heat to the outdoors (as during cooler weather) or the transfer of heat from the outdoors (as during hotter weather) is regulated to prevent unwanted heating or cooling losses and substantially improve the thermal efficiency of domestic and commercial heating/cooling systems.

Another object of the present invention is to provide an improved heat shield which can be placed in an infinite variety of positions to permit or inhibit the passage of all or some sun rays through a pane to comply with the particular desires of the operator for the efficient use of the energy available to him.

A still further object of the present invention is to provide an improved heat shield which will allow an operator to block direct sun rays while permitting the passage of indirect sun rays into a room.

Still another object of the present invention is to provide a new and improved heat shield which is adjustable to provide a fully closed and a fully open position with infinite additional positions intermediate thereof.

Still another object of the present invention is to provide a new and improved heat shield which, when placed in its fully closed position functions to block outdoor convective air currents from flowing over the surface of the protected pane thereby avoiding the chill-factor (during winter) or the heat factor (during summer) which would otherwise result therefrom.

These and still further objects as shall hereinafter appear, are fulfilled by the present invention in a remarkably unexpected fashion as will be readily discerned from the following detailed description of exemplary embodiments thereof, especially when read in conjunction with the accompanying drawing in which like members bear like reference numerals throughout the several views.

Figure 7:
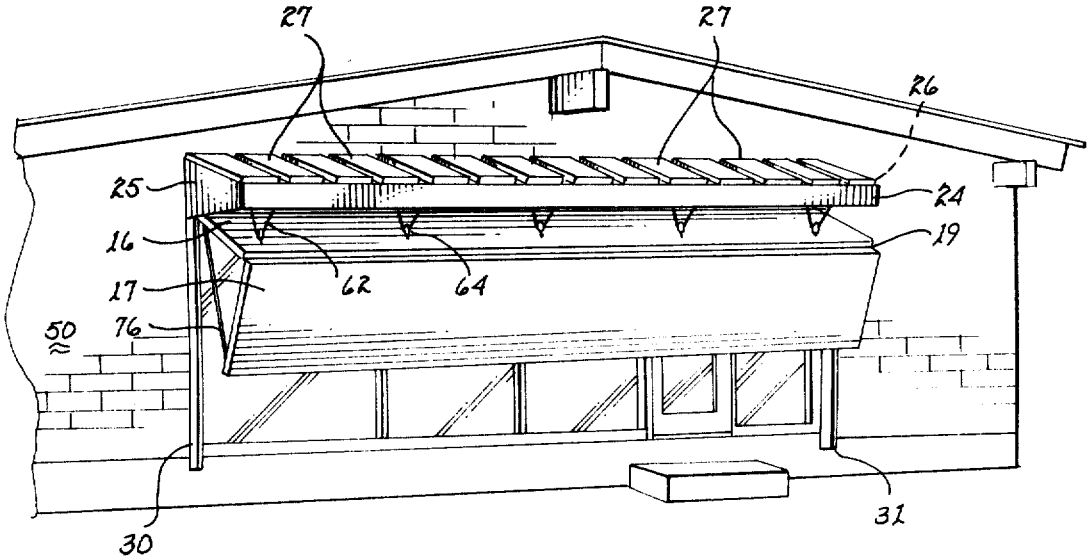
FIG. 7 is a frontal elevation of a multiple panel heat shield installed in a partially open position to control the passage of heat through a window wall and its associated door in accordance with the present invention.

The present invention, as shown in the drawings, relates to a multiple-panel or mono-panel adjustable heat shield 10. The multiple-panel may be mounted in association with the popular window walls comprising one or more large single pane windows, as shown in FIGS. 1, 2 and 7.

Figure 3:
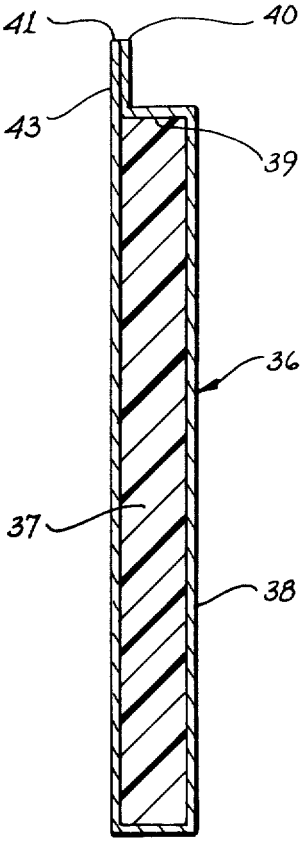
FIG. 3 is an end view, partially in section, showing a single heat shield panel embodying the present invention.
Figure 4:
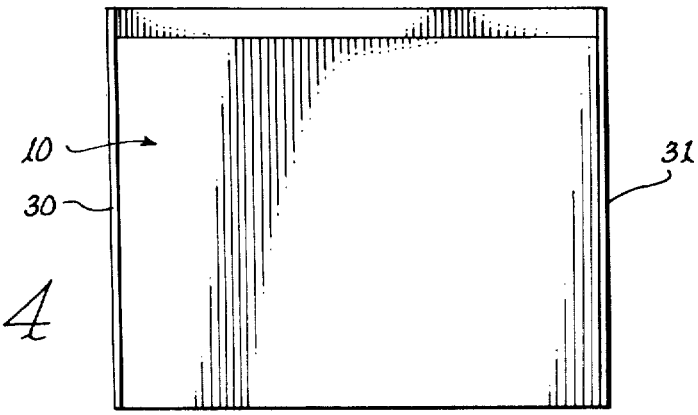
FIG. 4 is a frontal view of the panel of FIG. 3.
Figure 5:
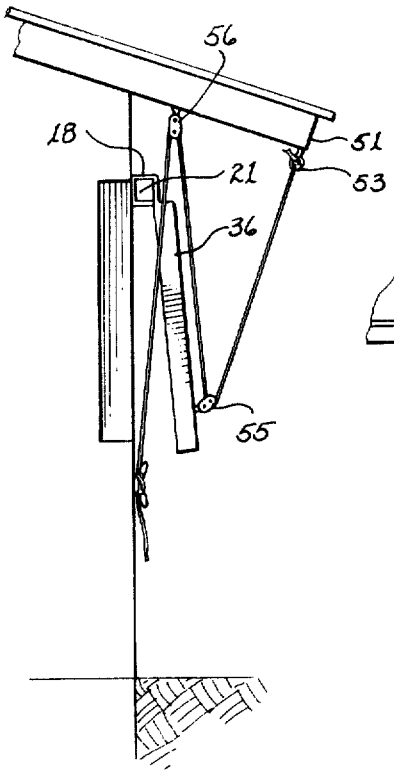
FIG. 5 is an end view showing a single panel heat shield fabricated and installed in accordance with the present invention.
Figure 6:
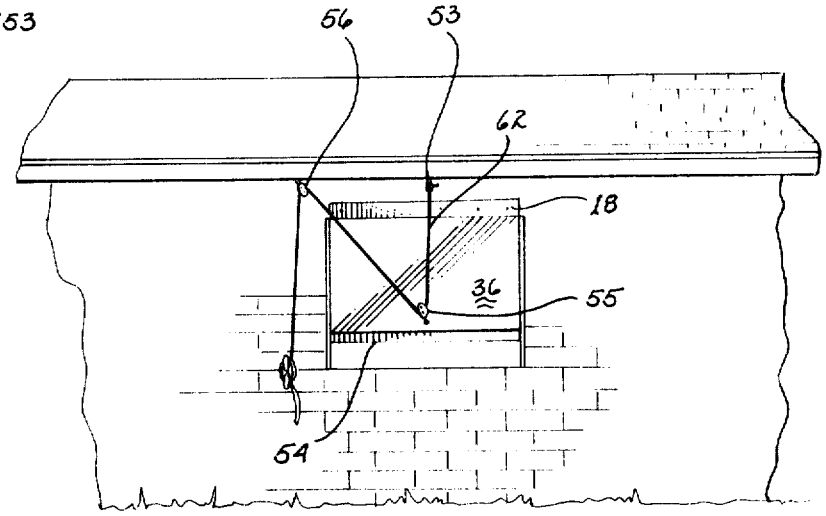
FIG. 6 is a frontal elevation of the panel of FIG. 5 in operative association with one system of adjusting the opening thereof.

The single-panel heat shield 10 may be beneficially employed with smaller single pane windows or areas of like dimension as shown in FIGS. 5 and 6. The structure of the panels, irrespective of a multiple-panel or single-panel installation, will be essentially as shown in FIGS. 3 and 4.

Figure 1:
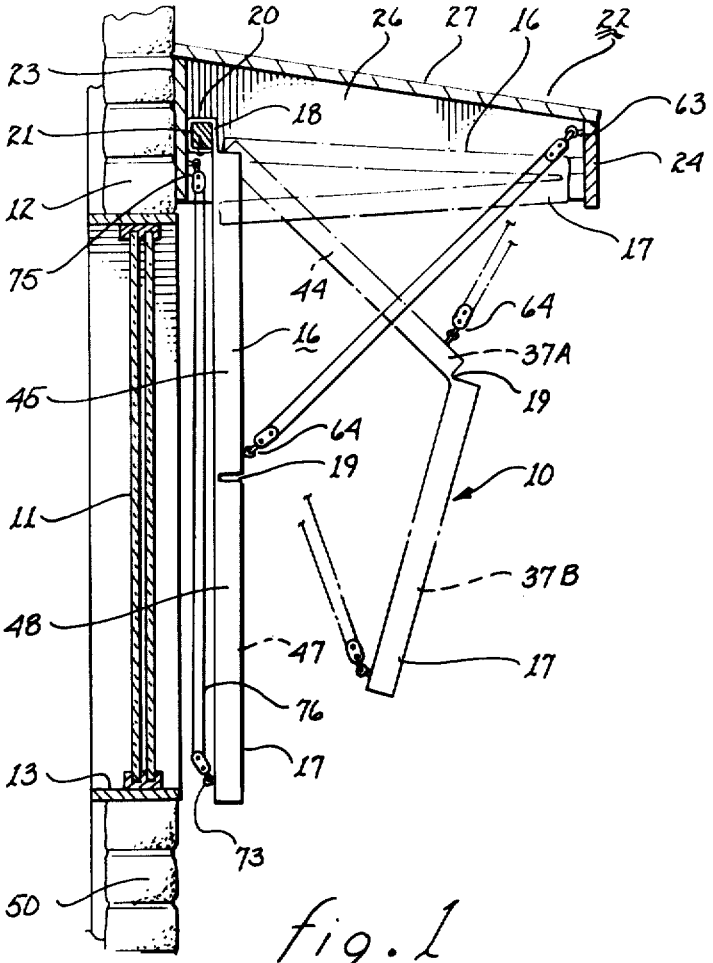
FIG. 1 is an end view, partially in section, showing a multiple panel heat shield, fabricated and installed in accordance with the present invention, in fully open, partially open and fully closed positions.

Referring now to FIG. 1, let us consider a representative multiple-panel heat shield 10, constructed in accordance with the present invention and mounted in connection with a window 11 having a header 12, a sill 13, and side jambs 14,15. Heat shield 10, as illustrated in FIGS. 1, 2 and 7, comprises an upper panel 16 and a lower panel 17. Upper panel 16 is swingably mounted relative to the window 11 as by a first hinge means 18. A second hinge means 19 is disposed between and hinges upper panel 16 to lower panel 17. Hinge means 18 is obtained by wrapping an upwardly extending flap 20, hereinafter described in detail, around a laterally extending snubber bar 21 which in turn is secured to header 12 or the backboard 23 of the canopy 22, as will be described hereafter.

Figure 2:
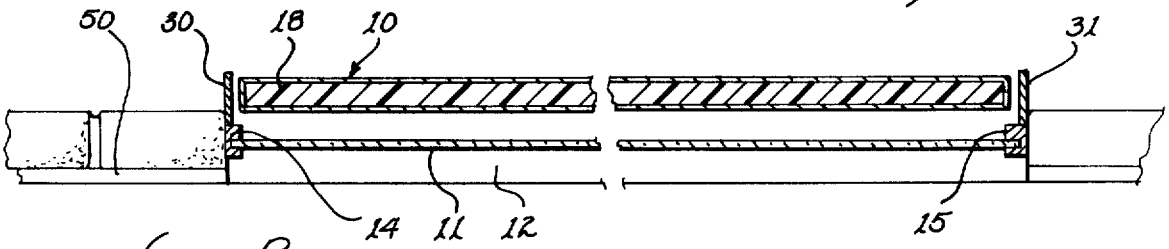
FIG. 2 is a plan view of the heat shield of FIG. 1 with the canopy removed for clarity.

In installations where it is impractical to extend heat shield 10 into the normal frame surrounding window 11, i.e., between jambs 14,15 a pair of vertically extending casement boards 30,31 will be installed which are secured to and depend from canopy 22 in spaced parallel relationship to each other, one being adjacent each vertically extending edge of shield 10 as shown in FIG. 2.

The first hinge means 18 hinges the upper panel 16 to the header 12, as indicated, while the second hinge means 19 hinges the upper part of lower panel 17 to the lower part of upper panel 16. The unique formation of hinge means 18, 19 in connection with the fabrication of panels 16,17 will be hereinafter described in detail.

Adjacent the header 12 and extending outwardly from the plane of window 11 is a canopy 22 which, as will be hereinafter described in detail, comprises a backboard 23 and a faceboard 24, joined at their respective ends by end members 25,26 by a plurality of slats 27 to provide a hidden nesting place for panels 16,17 when heat shield 10 is positioned to fully expose the area with which it is mounted, that is in its fully open position, and a supporting structure for adjusting means 33 which operates to alter or maintain the panels 16,17 in a variety of positions relative to window 11.

Referring to FIG. 3, most window installations, other than the window wall referred to above, can enjoy the benefits of the present invention with a single heat shield panel 36 which, as will appear, is fabricated in substantially the same manner as panels 16,17.

Specifically, each panel, for example, panel 36, is formed of a lightweight rigid foam insulative core 37 which is encased in a skin-tight fabric 38 to form an integral unit therewith.

In a preferred practice of the invention, core 37 is formed of polyurethane, which in independent testing has been found to provide a heat insulative barrier at two inches thick equivalent to an adobe brick wall having a thickness of 44.6 inches. Alternatively, polystyrene or urea formaldehyde may be used instead of polyurethane with only slight variations in insulative properties. Similarly, the preferred fabric for the practice of this invention is a nylon fabric, laminated with a vinyl polymer such a polyvinyl chloride and comparable to that which is manufactured and distributed under the brand name "Weblon". This material is sufficiently light colored to provide a heat reflective surface without the application of any additional paint or pigment although if another darker fabric is chosen, the application of an appropriate light reflective paint or pigment is well within the art to which this invention pertains.

Cover 38 serves not only to provide a protective skin for core 37, the manner in which it is folded and stitched enables cover 38 to provide panel 36 with a hinge means 18 adjacent the upper edge 39 thereof.

Hinge means 18 is formed by extending the fabric cover 38 across edge 39 and upwardly therefrom to provide a frontal piece 40 in abutment with another portion 41 extending upwardly in the rearward plane 42 of panel 36 and then stitching or otherwise adhering such extensions to each other to define flap 43 which is adapted for wrapping around snubber bar 21 which, when secured to header 12 or backboard 23, supports panel 36 between end members 25,26 of canopy 22.

Hinge means 18, thus defined, cooperates with snubber bar 21 to provide a swingable hinge for panel 36.

When, as earlier described, a double or multiple panel heat shield is desired, the aforesaid first hinge means 18 corresponds in structure and function to the hinge means 18 just described relative to the single panel heat shield 36. In the both installations, hinge means 18 is operative to pivot the adjacent heat shield panel, that is, panel 16 or panel 36, relative to the adjacent canopy 22 and header 12, in the same fashion.

Alternatively, the double panel hinging may be created by utilizing a continuous sheet of fabric which is folded and stitched to provide first hinge means 18, the containment for upper panel 16, second hinge means 19, containment for lower panel 17, and finally an upwardly extending flap 20 adjacent the upper edge of panel 17, which is created by joining the two loose ends of the continuous fabric sheet. This folding and sewing is illustrated in FIG. 8.

Figure 8:
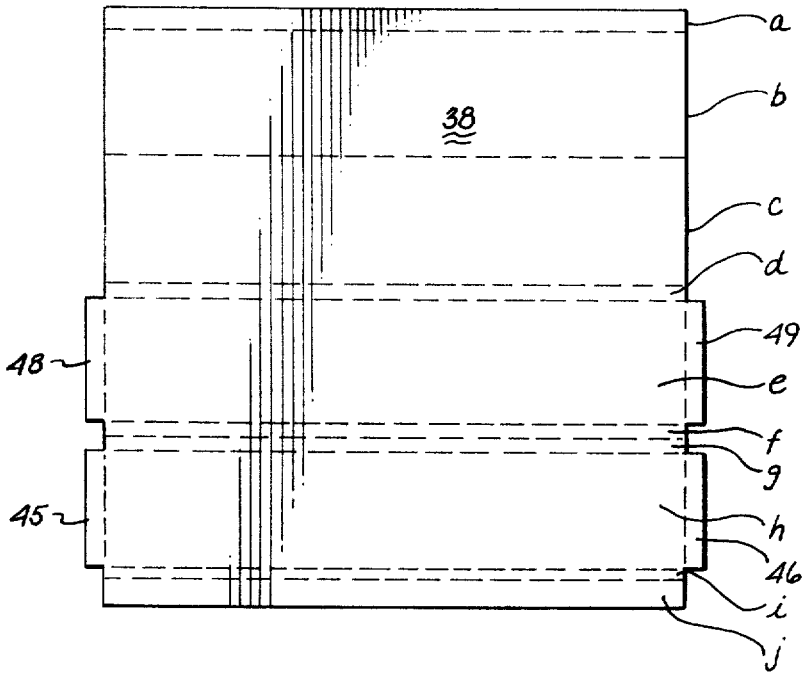
FIG. 8 is a plan view of a single sheet of fabric marked for folding and stitching to provide a cover for a double-panel heat shield in accordance with this invention.
Figure 9:
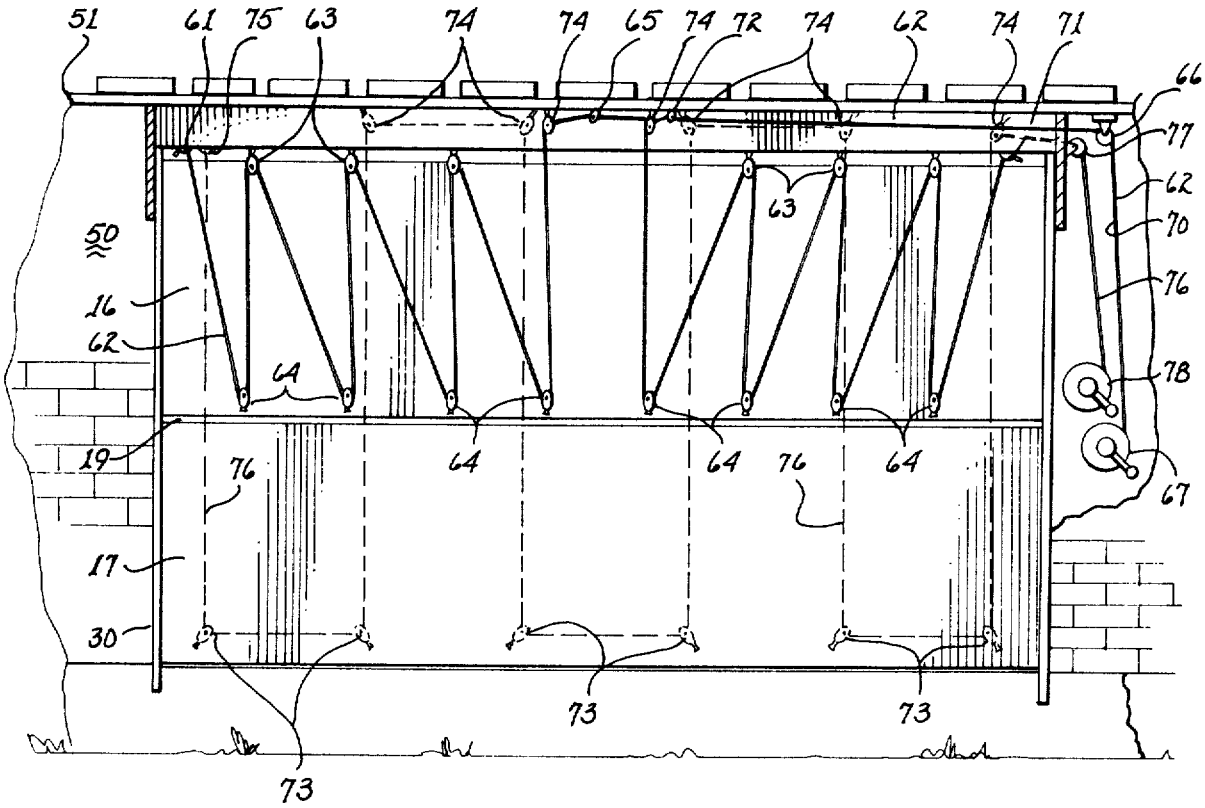
FIG. 9 is a vertical elevation of a double panel heat shield in operative association with a system of selectively actuating the panels into a variety of positions, the rearward parts being shown in phantom.

Specifically referring to FIG. 8, fabric cover 38 is shown, by dotted lines, to comprise ten horizontal sections identified as "a,b,c,d,e,f,g,h,i and j" starting with the smaller section adjacent the top of the drawing and proceeding downwardly therefrom for ease of description.

To fabricate a covered double panel shield, the preferred practice comprises wrapping cover 38 around a first pre-dimensioned pre-formed urethane core 37A and a second pre-dimensioned pre-formed urethane core 37B so that section "c" (referring to FIG. 8) covers the back of the core forming the lower panel (for instance, core 37B), section "d" covers the lower edge of core 37B, section "e" covers the front face of core 37B, and section "f" covers the top edge of core 37B thereby flaps 48 and 49 are folded over the respective ends of the core to totally cover 37B and form a complete panel 17.

Continuing, cover 38 is now mounted on core 37A in such a manner that section "b" covers the back surface of core 37A leaving section "a" extending outwardly therefrom for a purpose to be hereinafter described. Next, section "g" is disposed to cover the lower edge of core 37A while the common line defining the boundry between sections "f" and "g" is engaged with and secured to by gluing, stitching or the like to the boundary disposed between sections "b" and "c" to define hinge means 19 therewith. Continuing, section "h" covers the front surface of core 37A and section "i" covers the upper edge of the same core leaving section "j" extending upwardly therefrom for coaction with section "a" to form flap 20 which, as previously explained, is secured to and wrapped around snubber bar 21 to swingably support heat shield 10 by hinge means 18. Flaps 45,46 are folded over the ends of core 37A to complete upper panel 16.

In an alternative practice, sheet 38 is folded along both edges of section "d" to define a bottom for lower panel 17. Next the line dividing sections "b" and "c" is mated with the line dividing sections "f" and "g" and sewn, glued or otherwise adhered thereto to define the cover of the top edge of panel 17 (section "f"), the cover for the bottom edge of panel 16 (section "g") while the seamline defines the axis of rotation for second hinge means 19. At the same time, the cover for panel 17 is defined by the coaction of sections "c" and "e" with sections "d" and "f" after the seam is created.

Finally, section "a" and section "j" are mated and attached to each other to define flap 20 and complete a cover for panel 16 by the coaction of sections "b" and "h" between the coation of section "g" and "i" which is disposed between flap 20 and hinge means 19.

Thus folded and secured, cover 38 defines an upper chamber 44, having end flaps 45,46 extending outwardly therefrom, and a lower chamber 47, having end flaps 48,49 extending outwardly therefrom.

Next, end flaps 45,48 are folded across and secured to the rear section of their respective chambers, that is, flap 45 is secured to section "b" and flap 48 is secured to section "c". Now the chambers 44,47, now pockets, can be engaged with a suitable injection molding device so that wet urethane foam can be forced into the respective pockets 44,47 to fill the pockets with foam which, when cured, becomes cores 37A,37B and coact with cover 38 to form panels 16,17. After the cores have been formed, flaps 46,49 are folded over to complete the enclosure of pockets 44,47 and, when secured to the section adjacent thereto in the manner already described, complete the respective panels.

It is apparent that either of the foregoing techniques may be employed to fabricate a single panel (shown at 36) by using a smaller sheet of fabric and eliminating those steps which are used to form the second hinge and the second pocket.

Of course, when injection molding equipment is not available, pre-dimensioned pre-formed urethane slabs can be obtained and inserted into the pre-formed pockets to create a shield which will obtain all of the thermal shielding of the injection molded panels or the panel created when the fabric is wrapped around such preformed panels in accordance with the preferred practice. Other variations which obtain the same structural and insulative effect are intended to be embraced with the scope of this disclosure.

Having described the structure and the fabrication of the various panels employed to create the novel thermal shield of this invention, attention will now be directed to the installation of the panels and the coaction between the panels and the mounting and adjusting assemblies used therewith to operatively realize the full benefits hereof.

Consider first the operative installation of a single panel unit such as might be used with a mobile home or a small sun-facing window in a building or home. Above the window, attached to the wall of the structure is canopy 22, having end boards 25,26 between which is operatively and independently mounted snubber bar 21 from which panel 36 is suspended by the coaction of the hinge means 18 therewith.

In each such installation, the canopy 22, preferably formed from construction grade lumber, is created and secured to the wall 50 in any suitable fashion such as by lag screws and anchors. Each canopy 22, in addition to the end boards 25,26 previously defined, comprises a backboard 23 which supports the end boards 25,26 thereupon and a smaller faceboard 24. In larger installations, additional internal rafters 27 are placed in spaced relationship to each other and extend between backboard 23 and faceboard 24 to enhance the strength of the canopy 22 and provide a slotted roof therefor. The canopy 22 is dimensioned in any event to receive the rigging (hereinafter described) and the upper panel 16 (when the multiple-panel installation is in its "open" position) without either interfering with the other.

The slatted roof provided canopy 22 in the manner described also creates aesthetic values for the installation, both by its structural appearance and by the interesting shadows it produces on the heat shield when the sun is faced upon it as well as the structural value already ascribed to it. The slatted roof also prevents the accumulation of snow and sleet upon the canopy during northern winters.

It is of course understood that arrangements other than the canopy herein described may be used to suspend the heat shield in its operative position and in homes utilizing eaves of wide overhang. Thus, snubber bar 21 may be supported in simple brackets (not shown) secured to or under the eave and depending therefrom in an operative location relative to the opening to be protected.

The single panel 36 is then suspended by hinge means 18 from snubber bar 21 so that its dimensions essentially coincide with the dimensions of the opening it is designed to protect and the opening will be fully covered by the panel when the panel is in its so-called "closed" position.

The selective positioning of the panel between its fully closed position and its fully open position can be achieved in a number of ways, ranging from wholly manual to fully automatic, depending on the desires of the owner and the amount he wishes to spend. No matter how exotic or mundane the actual adjusting means selected may be, the operation will involve the same principles which will now be described.

Referring to FIG. 6, an adjusting means 33 is shown to illustrate the operation thereof in a basic fashion.

Thus, an anchor means 53 which may be an eye-bolt or the like, is secured to the overhanging eave 51 in alignment with and above the center point of the lower edge 54 of panel 36 to which guide means 55 is secured. Another guide means 56 is mounted on eave 51 positioned outwardly from panel 36 and means 55.

Adjacent one side of the installation, securing means 61 comprising a line cleat of the type used for the halyards of flag poles, boats and the like is mounted to the wall of the house and a suitable cable or cord 61 is then secured to anchor means 53, strung through guide means 55 and 56 for attachment to securing means 61 when, by the manual movement of cable 61 the desired position of panel 36 relative to the opening it has been installed to shield, has been obtained. As described, panel 36 can be placed in its fully open or fully closed position or at any intermediate position and once so located will not move until the operator chooses because the system of winding cable 61 about line cleat 61 holds the cable in a fixed position. If desired, cable 61 may be reeved on the rotor of an electric motor (not shown) disposed within the building to provide inside control of shield movement. Another variant can be created using basic mechanics by placing a counterbalance adjacent the shield installation.

The principles described with respect to the single panel installation are also applicable to the multiple panel installation but in a more sophisticated manner because of the need to selectively control the position of each panel relative to the opening it shields.

Thus, in one embodiment of the multiple panel installation, adjusting means 33 is provided utilizing the line and pulley system which will be essentially the same whether the heat shield is supported by an existing projection, such as an overhanging eave, or by an added projection such as the canopy structure previously described.

The principal difference between the multiple panel rigging and the single panel rigging arises from the need to obtain a distribution of the cable forces along the full width of the multiple panel because of its increased weight and size relative to the single panel.

A preferred arrangement is obtained when a rope 62 is anchored at one end adjacent the outer edge of upper panel 16 in faceboard 24 as by anchor means 53, and then strung through a series of pulleys 63,64 which are disposed in spaced relationship to each other across the upper and lower edges of panel 16 respectively. Thus, by cable 62 is strung from its secured position at 53 angularly downward to a pulley 64 disposed on the lower edge of panel 16, straight upwardly therefrom to the corresponding pulley 63 disposed adjacent the upper edge thereof, angularly downward to the next spaced pulley 64 on the lower edge, straight upwardly again to the corresponding pulley 63 on the upper edge and so on until reaching the upper edge pulley 63 nearest to and adjacent the vertical center line of the panel. In the preferred practice, pulleys 64 are mounted upon panel 16 whereas pulleys 63 are secured to the back surface of faceboard 24 adjacent the upper edge of panel 16.

When line 62 has been strung in the manner described and has reached the pulley 63 nearest the vertical center line of panel 16, it is then passed rearwardly to a guide pulley 65 mounted on backboard 23 and then passes horizontally to a double pulley 66 disposed adjacent end board 26 in vertical juxtaposition to suitable driving means as crank 67.

Likewise, a second line 70 is anchored by securing means 71 and courses through similarly disposed pulleys 63,64 mounted as indicated until it reaches its pulley 63 adjacent the vertical center line of panel 16 (shown left of center) and then rearwardly to guide pulley 72 secured in backboard 23 adjacent pulley 65. From there line 70 passes horizontally to a second channel in pulley 66 and both lines 62,70 are then anchored to the rotor member of driving means 67 where, in response to the selective actuation thereof, more or less line is available and the position of upper panel 16 is thereby controlled.

Lower panel 17 has been found to possess substantially less swing weight than that of upper panel 16, (since the upper panel 16 obtains not only its swing weight but the entire dead weight of panel 17), and as a result, fewer block and tackle arrangements are required to effectuate the desired control of this panel.

Accordingly, in one suitable installation, panel 17 is provided with a first plurality of pulleys 73 mounted adjacent and in substantially parallel relationship to the bottom edge of panel 17 in spaced relationship to each other and a second plurality of pulleys 74 mounted on overhang 51 so that each pulley 74 is in vertical registry with the corresponding pulley 73.

A line anchor 75 is disposed in bar 21 above panel 17 and line 76 is secured thereto. From anchor 75, line 76 courses straight downwardly to and through pulley 73, horizontally to and through adjacent pulley 73, straight upwardly to and through pulley 74, horizontally to and through next adjacent pulley 74, downwardly to and through pulley 73 and so on until it passes through the outermost pulley 74 on the upper line. From pulley 74, line 76 passes to a double pulley 77 disposed on the building adjacent the opening and thereafter to the rotor of independent driving means 78.

Thus rigged, the actuation of driving means 67 enables the operator to selectively adjust the position of panel 16 relative to the pivot provided by hinge means 18 and bar 21. The selective coordination of driving means 67 and 78 enables the operator to obtain any desired position of panels 16 and 17 relative to each other and to the opening being protected so that any position, including and between "fully open" and "fully closed" is readily obtained and the operator is able to obtain whatever degree of shielding may be dictated by the exigencies of the prevailing weather conditions.

From the foregoing it is apparent that a novel adjustable heat shield has been herein described and illustrated which fulfills all of the aforesaid objectives in a remarkably unexpected fashion. It is of course understood that such alterations, adaptions and modifications as may readily occur to the artisan when confronted with this disclosure are intended within the spirit of this invention, which shall be limited only by the scope of the claims appended hereto.

What is claimed is:

1. A heat shield mounted to a structure for controlling the flow of heat to and from a desired structural area associated therewith, said shield comprising: an elongated substantially rigid rectangular body portion formed of a light weight heat-insulative material; a snubber bar mounted horizontally on the associated structure in fixed operative relationship adjacent to and superposed with the desired structural area in substantially parallel relationship to the uppermost edge of said body portion; a unitary flexible skin member integrally formed upon said body portion in total enveloping relationship therewith and having a flap portion extending upwardly therefrom at the uppermost edge of said body portion, said extending flap portion being wrapped about said snubber bar and cooperating therewith to provide said body portion a fixed horizontal axis for selective movement thereabout; and actuating means operatively connected to said body portion and selectively actuatable to move or hold said body portion relative to said snubber bar axis and control the flow of heat to and from said desired structural area

2. A heat shield according to claim 1 in which said skin member comprises a heat reflective fabric.

3. A heat shield according to claim 1 in which said body member comprises a plurality of individual rigid rectangular panel members formed of said light weight heat insulative material and disposed within and enveloped by said unitary flexible skin member in spaced relationship to each other whereupon said skin member defines a ligamentary watertight flexible hinge between adjacent panel members to permit said adjacent panel members to pivot thereabout.

4. A heat shield according to claim 3 disposed in operative relationship to said structural area for which is desired the control of thermal transmission therethrough comprising means for vertically suspending said heat shield in operable juxtaposition with said opening and permitting pivotal movement of said first panel thereabout, first adjustment means selectively actuatable to move said first panel into a preselected angular relationship relative to said suspending means, second adjustment means selectively actuatable to move said panel relative to said first panel about said ligature whereupon by selective actuation of said first and said second adjustment means, the desired control of thermal transmission through said opening is effectuated.

5. A heat shield according to claim 4 in which said adjustment means includes means to maintain said heat shield in said preselected position.

6. A heat shield according to claim 1 or 3 in which said body portion is formed of a light weight heat insulative material comprising a plastic foam selected from the group consisting of polyurethane and polystyrene.

* * * * *